United States Patent [19]

Howells et al.

[11] 4,154,791

[45] May 15, 1979

[54] INHIBITION OF CORROSIVE ATTACK BY SULFURIC ACID ON CARBON STEEL

[75] Inventors: Merwyn E. Howells, Rahway; Jack H. Van Sciver, Madison; William C. Knoll, Flanders, all of N.J.

[73] Assignee: Allied Chemical Corporation, Morristown, N.J.

[21] Appl. No.: 865,096

[22] Filed: Dec. 27, 1977

[51] Int. Cl.[2] ..... C23F 11/04; C23G 1/04; C23G 1/08

[52] U.S. Cl. ..... 422/12; 134/3; 134/41; 252/79.2; 252/146; 252/387

[58] Field of Search ..... 252/387, 8.55 E, 146, 252/79.1, 79.2; 134/3, 28, 41; 156/656, 664; 422/12

[56] References Cited

U.S. PATENT DOCUMENTS

| | | | |
|---|---|---|---|
| 2,971,819 | 2/1961 | Antelman | 423/523 |
| 3,316,179 | 4/1967 | Hoornstra et al. | 252/146 |
| 3,752,169 | 8/1973 | Rauch et al. | 134/41 |
| 3,887,488 | 6/1975 | Scott et al. | 252/387 |
| 3,972,987 | 8/1976 | Von Plessen et al. | 423/523 |
| 4,010,240 | 3/1977 | Von Plessen et al. | 423/523 |

*Primary Examiner*—Benjamin R. Padgett
*Assistant Examiner*—Irwin Gluck
*Attorney, Agent, or Firm*—Gerhard H. Fuchs; Robert A. Harman

[57] ABSTRACT

Addition of small amounts of nitric acid to aqueous sulfuric acid containing more than about 60% by weight of $H_2SO_4$ inhibits corrosive attack on carbon steel with which it may come in contact.

4 Claims, No Drawings

INHIBITION OF CORROSIVE ATTACK BY SULFURIC ACID ON CARBON STEEL

BACKGROUND OF THE INVENTION

Carbon steel is the most common, cheapest and most versatile metal used in chemical industry for construction of processing and storage equipment. Sulfuric acid is a material which finds wide use in chemical industry. Aqueous sulfuric acid containing less than about 60% by weight of $H_2SO_4$ is extremely corrosive with respect to carbon steel, so that carbon steel is not a suitable material of construction for processing and storage equipment for sulfuric acid at these concentrations. At concentrations of more than about 60% by weight of $H_2SO_4$ and up to about 100% $H_2SO_4$, carbon steel will generally show corrosive attack of less than about 0.02" per year at temperatures below 100° F. At temperatures above about 100° F., carbon steel is not a suitable material of constructions for sulfuric acid service involving sulfuric acid of concentration between about 60% and about 93% by weight. For sulfuric acid of that concentration, at temperatures above about 100° F., suitable materials of construction include glass, silicon iron, Hastelloy B and D (T.M.) Durimet 20 (T.M.), Worthite (T.M.), lead, Monel (T.M.), impervious graphite, tantalum, gold, platinum, zirconium, and molybdenum. However, even at temperatures below about 100° F. aqueous sulfuric acid containing between about 60% and 100% $H_2SO_4$, especially between about 78% and about 93% by weight $H_2SO_4$ is sufficiently corrosive towards carbon steel to cause severe concern from a safety standpoint, and to make use of carbon steel equipment uneconomical because of the high frequency with which the equipment must be repaired or replaced because of corrosive failure.

The present invention provides a cheap yet effective corrosion inhibitor to reduce corrosive attack of sulfuric acid containing more than about 60% by weight of $H_2SO_4$ on carbon steel, at temperatures below as well as above about 100° F. and up to about 150° F.

SUMMARY OF THE INVENTION

In accordance with the present invention, a method of reducing corrosion attack by aqueous sulfuric acid containing more than about 60% by weight of $H_2SO_4$ on carbon steel with which it may come in contact is provided, which comprises adding nitric acid to such sulfuric acid in amount sufficient to establish in said sulfuric acid a nitric acid concentration of from about 0.1 to about 5% by weight.

The sulfuric acid which may be rendered less corrosive with respect to carbon steel in accordance with the present invention may be virgin sulfuric acid, or may be spent sulfuric acid containing varying amounts of impurities, of organic or inorganic nature. Spent sulfuric acid containing organic impurities may, for example, be derived from the sulfuric acid used in petroleum refining operations, including the alkylation process, and from sulfuric acid used in sulfation, sulfonation and nitration processes. Spent sulfuric acid containing inorganic impurities may, for example, be obtained from hydrometallurgical leaching operations, metal pickling operations or in the process of making titanium dioxide pigment, and the like. Large amounts of such spent acids are produced daily and must be handled and stored.

Carbon steel, for purposes of the present invention, is the commercial form of iron containing carbon in any amount up to about 1.7% as an essential alloying constituent, and malleable when under suitable conditions. It includes low carbon steel containing less than about 0.25% by weight of carbon, also known as mild or soft steel; medium carbon steel containing in the order of about 0.25 to 0.6% by weight of carbon; as well as high carbon steel, also called hard steel, containing more than about 0.6% by weight of carbon.

It was surprising to find that addition of small amounts of nitric acid, which in itself exhibits corrosive propensities towards carbon steel, is effective in reducing corrosive attack of aqueous sulfuric acid containing more than about 60% by weight of $H_2SO_4$ on carbon steel.

Corrosion resistance of various materials of construction to sulfuric acid is, for example, shown in *Corrosion Data Survey,* 1960 Edition, compiled by G. A. Nelson, published by Shell Development Company, Emeryville, California, at pages 24 and 25.

DETAILED DESCRIPTION OF THE INVENTION, OF THE PREFERRED EMBODIMENTS, AND OF THE BEST MODE PRESENTLY CONTEMPLATED FOR ITS PRACTICE

Addition of nitric acid to the sulfuric acid which is to be treated in accordance with the present invention to effect inhibition of corrosive attack on carbon steel may be accomplished by simple addition followed by agitation to effect uniform distribution. Any type of nitric acid may be employed, standard grades of 42° Be being eminently suitable, although nitric acids of concentrations higher and lower than that may be effectively employed.

The nitric acid is employed in amount sufficient to establish at least an 0.1% by weight nitric acid concentration in the sulfuric acid. At concentrations lower than that, little corrosion inhibition is observed. It will usually not be desirable to employ the nitric acid in amount of more than about 5% by weight, because no additional protection is obtained by providing such higher nitric acid concentrations. Thus, the nitric acid is employed in amount sufficient to establish a nitric acid concentration of from about 0.1 to about 5% by weight, preferably from about 0.15 to about 2% by weight and, most preferably, from about 0.2 to about 1% by weight. The sulfuric acid may have a concentration between about 60 and about 100% by weight, desirably between about 60 and about 80% by weight, although sulfuric acid of concentration within the range of about 80 to about 93% by weight can be suitably treated in accordance with our invention.

The following examples further illustrate the present invention.

EXAMPLE 1

To reagent grade aqueous sulfuric acid containing 78% by weight of $H_2SO_4$, small quantities of 90% nitric acid were added to obtain 3 series of 5 samples each containing 0.2, 0.4, 0.6, 0.8 and 1.0% of nitric acid. A set of three control samples free of nitric acid was also provided. These 18 samples were held in separate glass flasks at 100° F. for seven days with mild agitation under total reflux. Duplicate A-285 grade carbon steel coupons were immersed in each of these samples. Three parallel sets of tests were run. In the first an air bubbler was used to maintain oxygen saturation in the acid (aerated). In the second, a nitrogen bubbler was used to keep the acid oxygen free (deaerated). In the third set, no gas was bubbled through the samples (control). The test coupons were weighed before the test as well as after seven days exposure to the acid. From the weight loss and the measured surface area of the test coupons, the corrosion rate in mils per year were calculated. The results are summarized in the table below.

TABLE I

| Percent Nitric Acid | Average Corrosion Rate (mils/year) Control | Aerated | Deaerated |
|---|---|---|---|
| 0.0 | 24.3 | 27.0 | 22.0 |
| 0.2 | 2.6 | 4.6 | 5.3 |
| 0.4 | 2.5 | 2.7 | 3.1 |
| 0.6 | 2.7 | 3.2 | 2.9 |
| 0.8 | 3.0 | 5.1 | 3.7 |
| 1.0 | 2.8 | 3.0 | 3.6 |

The results set forth in the Table show that corrosion rate of carbon steel exposed to 78% sulfuric acid is significantly reduced by addition of small amounts of nitric acid.

When aqueous sulfuric acid containing more than about 60% by weight of $H_2SO_4$ at concentrations other than 78% by weight is treated with small amounts of nitric acid at concentrations of from about 0.1 to 5% by weight, similar results are obtained, that is to say the corrosive attack of such acid on carbon steel is substantially reduced.

EXAMPLE 2

Following the procedure of Example 1, to samples of 78% $H_2SO_4$ were added various amounts of nitric acid, and A-285 grade carbon steel test coupons were immersed in these samples while maintained in glass flasks for 14 days at 100° F. under total reflux with mild agitation. The results are summarized in Table II.

TABLE II

| Percent Nitric Acid Added | Average Corrosion Rate (mils/year) |
|---|---|
| 0.0 | 14.2 |
| 0.05 | 31.3 |
| 0.075 | 13.3 |
| 0.10 | 16.6 |
| 0.15 | 3.8 |
| 0.20 | 2.4 |

EXAMPLE 3

To samples of spent sulfuric acid containing more than 60% but less than 100% $H_2SO_4$ nitric acid (90%) was added in amount sufficient to result in 0.2% $HNO_3$ concentration in the mixtures. Duplicate A-285 carbon steel test coupons were exposed to these samples as well as to control samples at 100° F. for seven days under total reflux with mild agitation. Resulting corrosion rates are shown in Table III, below.

TABLE III

| Acid | Corrosion Rate (mils/year) Control | Acid Containing 0.2% $NNO_3$ |
|---|---|---|
| Detergent Spent Acid | 38 | 2.5 |
| Nitration Spent Acid | 120 | 49 |

Since various changes may be made in carrying out our invention without departing from its scope and essential characteristics, it is intended that all matter contained in the above description shall be interpreted as illustrative only. The invention being limited solely by the appended claims.

We claim:

1. The method of reducing corrosion attack by aqueous sulfuric acid, containing more than about 60 percent by weight of $H_2SO_4$, on carbon steel with which it may come in contact, which comprises adding nitric acid to said sulfuric acid, in amount sufficient to establish in said sulfuric acid a nitric acid concentration of from about 0.1 to about 5 percent by weight.

2. The method of claim 1 wherein the aqueous sulfuric acid contains more than about 60 but less than about 80 percent by weight of $H_2SO_4$.

3. The method of claim 1 wherein the nitric acid is added in amount sufficient to establish in the sulfuric acid a nitric acid concentration of from about 0.15 to about 2 percent by weight.

4. The method of claim 1 wherein the aqueous sulfuric acid contains more than about 60 but less than about 80 percent by weight of $H_2SO_4$, and wherein the nitric acid is added in amount sufficient to establish in said sulfuric acid a nitric acid concentration of from about 0.15 to about 2 percent by weight.

* * * * *